United States Patent [19]

Kicherer

[11] Patent Number: 4,527,050

[45] Date of Patent: Jul. 2, 1985

[54] HOTPLATE

[75] Inventor: Robert Kicherer, Knittlingen, Fed. Rep. of Germany

[73] Assignee: E.G.O. Elektro-Gerate Blanc und Fischer, Fed. Rep. of Germany

[21] Appl. No.: 393,487

[22] Filed: Jun. 29, 1982

[30] Foreign Application Priority Data

Jul. 8, 1981 [DE] Fed. Rep. of Germany ..... 3126989

[51] Int. Cl.[3] ..... H05B 3/68

[52] U.S. Cl. ..... 219/464; 219/460; 219/462; 219/467; 219/543; 338/217; 338/293; 338/314

[58] Field of Search ..... 219/445, 458, 459, 460, 219/461, 463, 464, 466, 467, 522, 543, 449; 338/217, 218, 287, 292, 293, 295, 308, 309, 314

[56] References Cited

U.S. PATENT DOCUMENTS

| | | | |
|---|---|---|---|
| 2,691,717 | 10/1954 | Huck | 219/462 |
| 2,777,930 | 1/1957 | Nathanson | 219/543 |
| 2,784,287 | 3/1957 | Glynn | 219/464 X |
| 2,859,321 | 11/1958 | Garaway | 219/543 X |
| 2,870,316 | 1/1959 | Ferguson, Jr. | 219/464 X |
| 3,067,315 | 12/1962 | Hurko | 219/464 X |
| 3,086,101 | 4/1963 | Scofield | 219/460 |
| 3,245,023 | 4/1966 | Schmidt | 219/543 X |
| 3,316,390 | 4/1967 | Gaugler et al. | 219/464 |
| 3,379,858 | 4/1968 | Peters | 219/543 |
| 3,622,754 | 11/1971 | Hurko | 219/462 |
| 3,646,321 | 2/1972 | Siegea | 219/464 |
| 3,686,477 | 8/1972 | Dills et al. | 219/462 |
| 3,791,863 | 2/1974 | Quirk | 219/543 X |
| 3,811,934 | 5/1974 | Geazer | 219/543 X |
| 3,813,520 | 5/1974 | Brouneus | 219/543 |
| 3,816,702 | 6/1974 | Green | 219/543 X |
| 3,838,249 | 9/1974 | Delter-Beck | 219/460 |
| 3,852,564 | 12/1974 | Baum et al. | 219/522 |
| 3,869,596 | 3/1975 | Hovie | 219/438 |
| 3,883,719 | 5/1975 | Hurko | 219/464 |
| 3,914,514 | 10/1975 | MacKenzie et al. | 428/426 |
| 3,974,360 | 8/1976 | Panzarino | 219/543 |
| 4,002,883 | 1/1977 | Hurko | 219/543 |
| 4,032,750 | 6/1977 | Hurko | 219/464 |
| 4,057,707 | 11/1977 | Allen | 219/543 |
| 4,057,777 | 11/1977 | Merz et al. | 338/309 |
| 4,063,068 | 12/1977 | Johnson et al. | 219/441 |
| 4,087,778 | 5/1978 | Merz et al. | 338/309 |
| 4,104,421 | 8/1978 | Maher et al. | 338/309 |
| 4,384,192 | 5/1983 | Lowell et al. | 219/468 |

FOREIGN PATENT DOCUMENTS

| | | | |
|---|---|---|---|
| 1690557 | 2/1968 | Fed. Rep. of Germany . | |
| 2203661 | 8/1973 | Fed. Rep. of Germany . | |
| 2215798 | 10/1973 | Fed. Rep. of Germany . | |
| 2411663 | 3/1974 | Fed. Rep. of Germany . | |
| 2355412 | 5/1975 | Fed. Rep. of Germany . | |
| 2518949 | 11/1975 | Fed. Rep. of Germany . | |
| 2524840 | 8/1976 | Fed. Rep. of Germany . | |
| 2819118 | 10/1979 | Fed. Rep. of Germany | 219/464 |
| 1531091 | 6/1968 | France | 219/463 |
| 608697 | 1/1935 | Netherlands . | |
| 1128059 | 4/1962 | Netherlands . | |
| 97774 | 1/1961 | Norway | 219/463 |

OTHER PUBLICATIONS (European Search Report, Publication No. 34/01-1-2-81).

*Primary Examiner*—Volodymyr Y. Mayewsky
*Attorney, Agent, or Firm*—Steele, Gould & Fried

[57] ABSTRACT

An electric hotplate has a hotplate body in the form of a thin ceramic substrate, to whose bottom surface is applied, e.g. by printing, a thin resistive material film. This resistive material film is covered by a protective coating, which prevents damage. Between the protective coating and the bottom tray of the hotplate is provided a thermal insulating layer. The hotplate has an extremely low thermal capacity, so that rapid preliminary cooking or boiling is possible with low power consumption.

16 Claims, 4 Drawing Figures

HOTPLATE

BACKGROUND OF THE INVENTION

The invention relates to a hotplate with a flat hotplate body having a substantially planar top and bottom in the heated area, electrical heating means engaging on the bottom of the hotplate body, as well as an optional bottom tray and/or an overflow edge.

It is already known to provide a thin coating of electrical material on the bottom of a glass ceramic cooking surface to which a resistive film heating element is adhered. The heating film and the electrical coating are pressed against the bottom of the glass ceramic hotplate by means of a spring mechanism (DOS No. 27 12 881). However, this solution has the disadvantage that only very low operating temperatures are possible, as the known glass ceramics become electrically conductive as from 300° C. It is also known to arrange such a film heating element in spaced manner below the hotplate (DOS No. 28 14 085).

It has already been proposed (P No. 30 33 828) to place on the bottom of a flat, metallic hotplate body a thin, flexible tubular heater, pressed by a spring mechanism against the bottom of the hotplate body. This electric hotplate has proved satisfactory.

SUMMARY OF THE INVENTION

The object of the invention is to provide a hotplate of the aforementioned type, which is particularly easy to construct and manufacture, which has a minimum thermal capacity and which ensures a very short preliminary cooking or boiling time in the case of relatively low electrical loads.

According to the invention this object is achieved in that in the case of a hotplate of the aforementioned type, the hotplate body is formed from a flat substrate made from a good thermally conducting, electrically insulating material, to whose bottom surface is applied a film of resistive material.

Advantageously the hotplate body is made from a ceramics material, e.g. of magnesium oxide, alumina or some other suitable techanical ceramic, such as e.g. KER 520. It is advantageously also possible to use baked or fired, reaction-bonded or hot-pressed silicon nitride, which has a low expansion coefficient, accompanied by good thermal conductivity and an extremely good thermal cycle stability. Due to its very adequate mechanical strength, high insulation values and good thermal conductivity it is possible to make the hotplate body thin, so that the resulting hotplate has a virtually negligible thermal capacity. As a result initial or preliminary cooking or boiling can take place very rapidly, without an excessive electric power consumption.

The resistive film is preferably evaporated-on in vacuum. However, it is particularly advantageous if it is applied by screen process printing. The resistor comprises a so-called cermet layer, being platinum, rhodium or some other suitable metal is pulverulently admixed in oxide form into a glass frit.

For thermal sensing purposes, one or more temperature-dependent substances with a negative (NTC) or positive (PTC) resistance coefficient can be applied in the same screen printing process.

In both cases a simple application and a good adhesion of the resistive film to the hotplate body are ensured.

According to a further development of the invention, the resistance value of the film is matched by cross-sectional reduction, which can in particular take place by means of a laser.

Advantageously the ceramic substrate is colored, so that the hotplate can be given an attractive appearance.

According to a further development the resistive film is subdivided into individual areas which are or can be insulated relative to one another. Thus, it is possible to separately heat individual areas or combinations of areas of the hotplate surface. For example, the innermost area can have a circular shape, while several circular ring areas can be added, thereby permitting an increase in the diameter of the operating hotplate.

According to another feature of the invention the resistive film has areas with different electrical surface loads. This measure makes it possible to adapt the heat given off by the individual areas to the cooking requirements. For example, it is possible to more intensely heat the outer area of a round cooking surface, which is particularly advantageous if commercially available saucepans are used, which generally only externally rest on the outer ring of the hotplate.

According to another feature of the invention the areas are constructed in ring-shaped or circular manner.

In order to bring about a good downward thermal shielding of the hotplate, according to the invention below the resistive film, i.e. between the latter and an optionally provided bottom tray, there is a thermal insulation.

The electrical connections are advantageously brazed to the resistive film or to an additional silver coating. This represents a particularly favorable, space-saving and inexpensive fastening procedure, as no additional terminals are required at this point. The silver coatings can be produced during the production of the resistive film. As contacting, it is also possible to apply a silver-palladium coating by screen process printing and for example, brazing a sheet metal angle member or wedge thereon. On the latter, electrical contacting can be brought about by conventional resistance welding. Contacting can also be obtained by evaporating a nickel coating on in vacuum and then welding a metal angle member or wedge thereto, e.g. using the laser process.

The pull relief of these connections is advantageously brought about by the downwardly directed leg of the overflow edge.

In order to bring about a good and secure attachment of the hotplate within the cooker mounting depression, the invention also proposes that the downwardly directed leg of the overflow edge is provided with at least two bolts, which are used for fixing the hotplate into the depression with the aid of the fixing plate or bottom tray.

The substrate can also be fixed to the overflow edge in an extremely simple manner because, according to the invention, the heated plate is preferably sealingly adhered into the overflow edge by means of a ceramic adhesive. It is particularly advantageous in this case if the expansion coefficient of the overflow edge is adapted to that of the heated plate.

According to a further development of the invention the areas of the resistive film are shaped like circular or circular ring sectors. Thus, for example, a circular shape, like that of a normal hotplate, can be formed by eight identical circular sectors, one connection being connected to the center of the circle and the other to the circumference thereof. When the areas of the resistive film are constructed in the form of circular or circular ring sectors, they alternately have incisions or cuts on both sides. These cuts reduce the cross-section in the surface direction, so that the areas of the resistive film thus formed are shaped like a meander. Preferably in each case two sectors are symmetrical to one another with respect to their dividing line. This leads to the particular advantage of there being no twisting stresses on either side of a dividing line and consequently the potentials are the same on either side thereof. This also means that the insulating dividing lines between two areas can in each case be made as thin as is permitted by the process used for applying the resistive film. As a result the cooking surface has the same temperature at all points.

BRIEF DESCRIPTION OF THE DRAWINGS

Further features, details and advantages of the invention can be gathered from the following description of a preferred embodiment and the attached drawings, wherein.

DETAILED DESCRIPTION OF THE PREFERRED EMBODIMENTS

Figure 1:
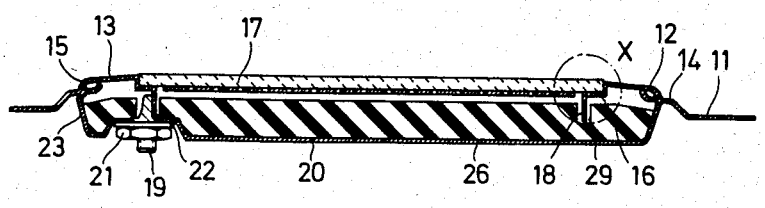
FIG. 1 is a longitudinal section through a hotplate according to the invention.

A hotplate with an overflow edge 12 is placed in a mounting opening of a cooker depression 11. The overflow edge has an all-round, approximately horizontally directed portion 13, whose outer rim is bent downwards. Between portion 13 and a portion 14 of cooker depression 11 is placed a sealing ring 15. Overflow edge 12 also has a shoulder 16 for receiving the hotplate body 17. On the side of shoulder 16 facing the center, overflow edge 12 has an all-round, flat cylindrical leg 18 to which are fixed three peripherally arranged screw bolts 19. Only one of the three screw bolts is shown in FIG. 1.

Figure 2:
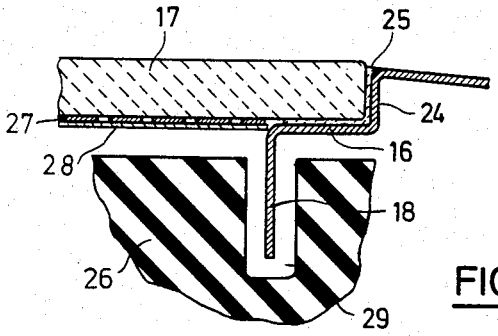
FIG. 2 is a larger-scale detail of the arrangement of FIG. 1 in the circle designated "X".
Figure 4:
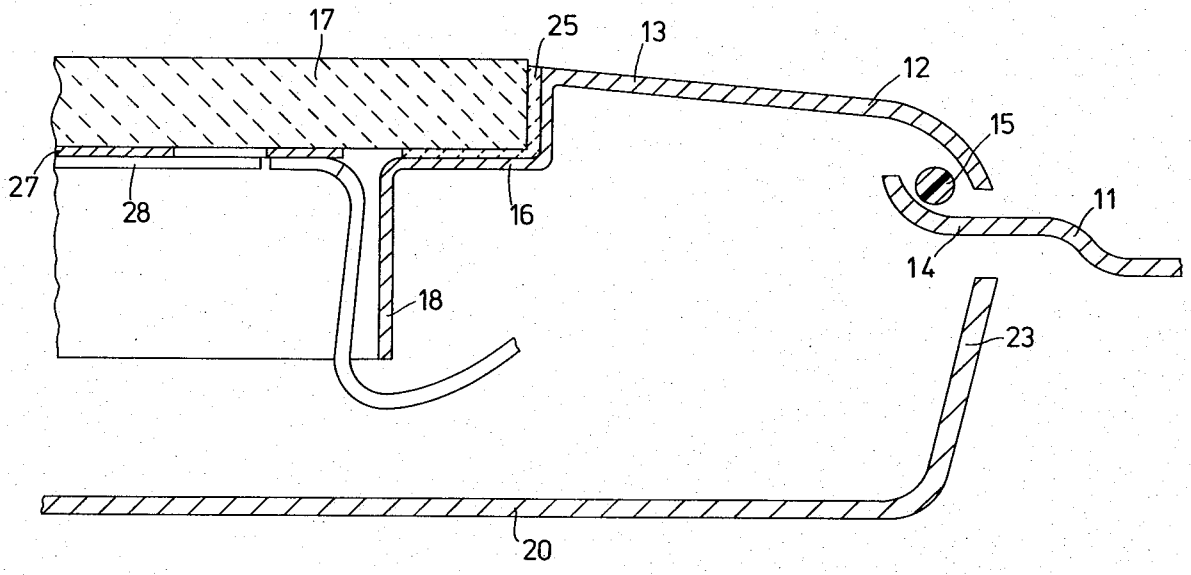
FIG. 4 is an enlarged partial section view of the hotplate of FIG. 1.

FIG. 4 is a partial section view illustrating these elements, in a larger and more-inclusive view than those of FIGS. 1 and 2.

Beneath, the hotplate is provided with a bottom tray 20 having a number of openings corresponding to the number of screw bolts 19 which pass through the openings. The bottom tray with its all-round rim 23 is pressed against the bottom of the cooker depression 11 by nuts 21 and washers 22 on bolts 19. In this way, overflow edge 12 and bottom tray 20 are fixed to the cooker depression 11.

Hotplate body 17, which according to the preferred embodiment is made from a ceramic material, is adhered by a thin ceramic adhesive coating 25 to shoulder 16 and the following, vertically directed step 24 of overflow edge 12, cf. FIG. 2.

Bottom tray 20 has on its top surface, i.e. the side facing the hotplate, a relatively thick layer 26 of insulating material, which has an all-round annular slot 29 for receiving leg 18 of overflow edge 12.

As can be gathered from FIG. 2 a resistive film 27 is applied to the bottom of hotplate body 17, e.g. is applied thereto by means of screen process printing. Resistive film 27 is directly applied to the hotplate body 17, because the latter is made from electrically insulating material. A thin protective coating 28 is applied to the bottom of resistive film 27, in order to protect the latter from mechanical damage.

Figure 3:
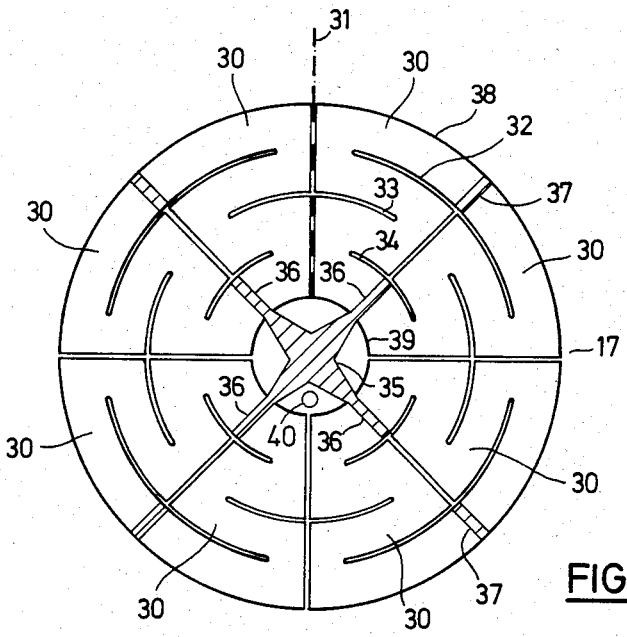
FIG. 3 a view from below of the resistive film of the hotplate of FIG. 1.

FIG. 3 is a view from below of hotplate body 17 of FIG. 1. For reasons of simplicity the overflow edge 12 is not shown. As can be gathered from FIG. 3, resistive film 27 comprises, in all, eight circular ring sectors 30. Each of the sectors 30 extends over an angle of approximately 45°. On considering the two upper sectors of FIG. 3, it is readily apparent that they are constructed symmetrically to dividing line 31. Each sector has cuts 32, 33 and 34, extending in each case along a concentric arc and giving each sector 30 a meanderlike appearance.

In the center of hotplate body 17 there is a star-shaped silver coating 35 with four arms 36, each of which passes into a gap between two sectors 30. One conductor, which is not shown for reasons of simplifying the drawing, is connected to the silver coating 35, while the second conductor engages from the outside on the four silver coatings 37, which also engage in gaps between two sectors.

To permit a particularly good adaptation of the thermal characteristics of the hotplate according to the invention, the specific surface load of sectors 30 can decrease from the outside to the inside. Thus, for example, the outer portion of each sector 30, i.e. the area between outer rim 38 of the sector and the first cut 32, can have a surface load of approximately 11.5 $W/cm^2$, while the area between inner rim 39 of sector 30 and the adjacent cut 34 has a surface load of approximately 8 $W/cm^2$.

Thermal sensors 40 can be formed by one or more temperature-dependent substances with a negative (NTC) or positive (PTC) temperature dependent resistance coefficient, applied by the same screen printing process used for the resistive layer.

I claim:

1. A hotplate having a flat hotplate body, with a heatable area having substantially planar top and bottom surfaces, an electrical heating means engaging the bottom surface of the heatable area of the hotplate body and electrical connectors for the heating means, the hotplate comprising:

the hotplate body being formed form a flat substrate of material characterized by good thermal conductivity and electrical insulation even at operating temperatures in excess of approximately 300° C.; and, a film of an electrically resistive material applied directly to the bottom surface of the heatable area of the hotplate body in a plurality of individual areas which are electrically insulated from one another, the resistive film being unevenly distributed among the individual areas to produce areas having different electric surface loads, whereby an annular outer area of the hotplate may be heated more intensely than the remaining inner area to accommodate typical cooking vessels which tend to engage hotplates in contact zones adjacent their perimeters, the hotplate exhibiting a very low thermal inertia which enables high cooking temperatures to be reached quickly and efficiently.

2. The hotplate of claim 1, wherein the resistive film is substantially co-extensive with the heatable area.

3. The hotplate of claims 1 or 2, wherein the hotplate body is formed from a ceramic material.

4. The hotplate of claim 3, wherein the ceramic substrate is colored.

5. The hotplate of claims 1 or 2, wherein the resistive film is printed onto the bottom surface of the hotplate body.

6. The hotplate of claims 1 or 2, wherein the resistive film is evaporated onto the bottom surface of the hotplate body.

7. The hotplate of claim 1, further comprising a mechanically protective coating over the resistive film.

8. The hotplate of claim 1, wherein the individual areas are shaped like sectors of a circle.

9. The hotplate of claim 1, further comprising a layer of thermal insulation disposed below the resistive film.

10. The hotplate of claim 1, further comprising electrical connections for the individual areas of the resistive film directly connected to the resistive film in each of the areas.

11. The hotplate of claim 10, wherein the hotplate body comprises a peripherial overflow edge having a downwardly directed annular leg, the leg providing strain relief for the electrical connections.

12. The hotplate of claim 1, wherein the hotplate body further comprises a peripheral overflow edge having a downwardly directed leg and the hotplate further comprises a thermally insulated bottom plate, the hotplate being attachable in a mounting aperture by at least two threaded connectors affixed to the downwardly directed leg which pressingly engage a rim of the aperture between the overflow edge and the bottom plate.

13. The hotplate of claims 1 or 2, further comprising a peripherial overflow edge for the hotplate body, affixed thereto by a ceramic adhesive.

14. The hotplate of claim 13, wherein the expansion coefficients of the hotplate body and the overflow edge correspond to one another.

15. The hotplate of claims 1 or 2, wherein the resistive layer comprises a cermet layer.

16. The hotplate of claim 1, further comprising at least one thermal sensor applied directly to the bottom surface of the hotplate body together with the resistance layer, the thermal sensor comprising material having a temperature-dependent coefficient of resistance.

* * * * *

UNITED STATES PATENT AND TRADEMARK OFFICE

CERTIFICATE OF CORRECTION

PATENT NO. : 4,527,050

DATED : July 2, 1985

INVENTOR(S) : Robert Kicherer

It is certified that error appears in the above-identified patent and that said Letters Patent is hereby corrected as shown below:

Column 3, line 26 after "3" insert --is--.

Column 4, line 46 delete "form" and insert --from--.

Signed and Sealed this

*Eighth* Day of *July 1986*

[SEAL]

*Attest:*

DONALD J. QUIGG

*Attesting Officer*

*Commissioner of Patents and Trademarks*